US007333746B2

(12) United States Patent
Nagata et al.

(10) Patent No.: US 7,333,746 B2
(45) Date of Patent: Feb. 19, 2008

(54) DEVELOPING DEVICE AND IMAGE FORMING APPARATUS PROVIDED WITH SAME

(75) Inventors: Tsutomu Nagata, Kyotanabe (JP); Takahiko Kimura, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 334 days.

(21) Appl. No.: 11/249,746

(22) Filed: Oct. 14, 2005

(65) Prior Publication Data

US 2006/0083541 A1 Apr. 20, 2006

(30) Foreign Application Priority Data

Oct. 15, 2004 (JP) ..... 2004-302214

(51) Int. Cl.
*G03G 15/08* (2006.01)

(52) U.S. Cl. ..... 399/103; 399/119; 399/120

(58) Field of Classification Search ..... 399/98, 399/102, 103, 107, 119, 120
See application file for complete search history.

(56) References Cited

U.S. PATENT DOCUMENTS 6,463,241 B2 * 10/2002 Ochiai ..... 399/252
6,790,575 B2 * 9/2004 Sasaki et al. ..... 430/106.1
6,868,247 B2 * 3/2005 Sato et al. ..... 399/281
7,155,151 B2 * 12/2006 Okamoto ..... 399/279

FOREIGN PATENT DOCUMENTS

| | | |
|---|---|---|
| JP | 4-248579 A | 9/1992 |
| JP | 6-308816 A | 11/1994 |
| JP | 10-26861 A | 1/1998 |

* cited by examiner

*Primary Examiner*—Hoan Tran
(74) *Attorney, Agent, or Firm*—Nixon & Vanderhye, P.C.

(57) ABSTRACT

A developing device is arranged such that Dg<ds<3Dg, and 3Dg<dc<6Dg, where ds is an end gap, Dg is an upstream gap, and dc is a center gap. The gap ds is a gap between a developer tank 4 and either end portion of a developing roller 1 in the downstream of a transportation direction of the developing roller 1. The end portion of the developing roller 1 is an end portion thereof with respect to a rotation direction of the developing roller 1. The gap Dg is a gap between the developing roller 1 and a doctor blade. The gap dc is a smallest gap between the developer tank 4 and the center portion b of the developing roller 1. With this arrangement, it is possible to prevent the toner scattering appropriately in the developing device for use of a two-component developer containing toner and carrier.

8 Claims, 4 Drawing Sheets

FIG. 3 (a) CROSS SECTIONAL VIEW TAKEN ALONG A-A
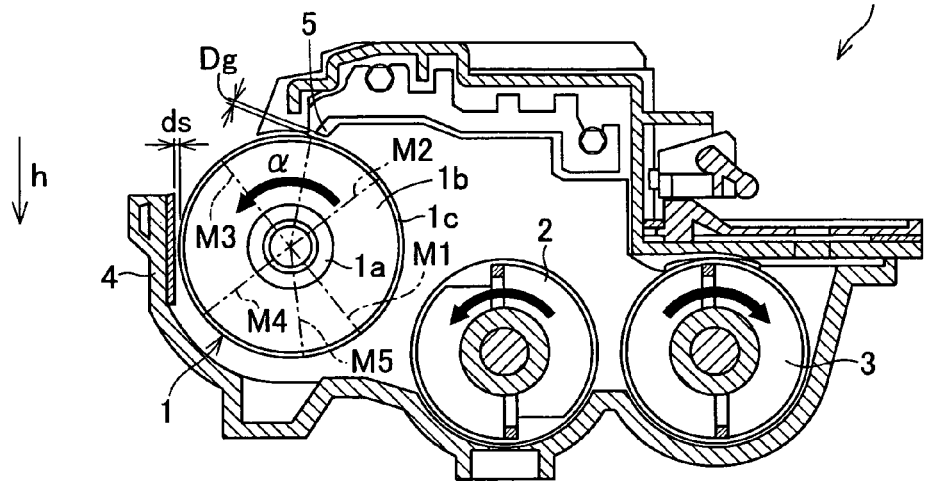
FIG. 3 (b) CROSS SECTIONAL VIEW TAKEN ALONG B-B
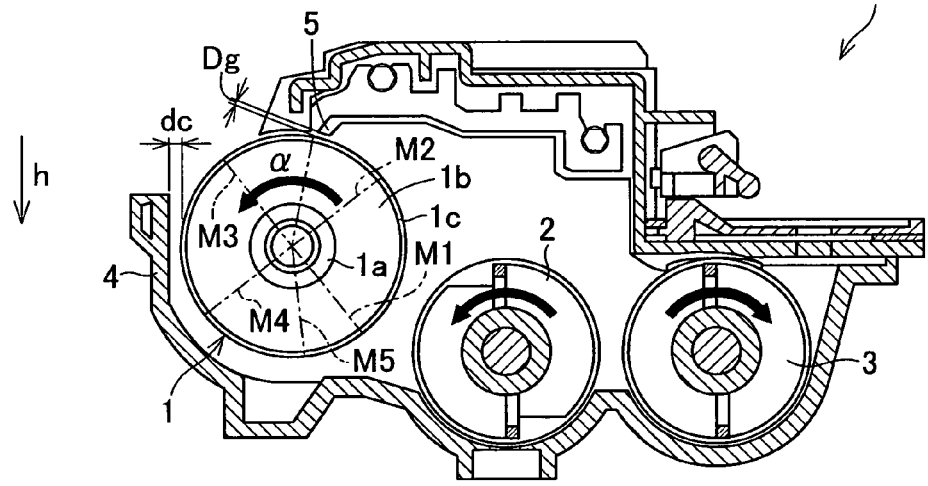
FIG. 3 (c) CROSS SECTIONAL VIEW TAKEN ALONG C-C
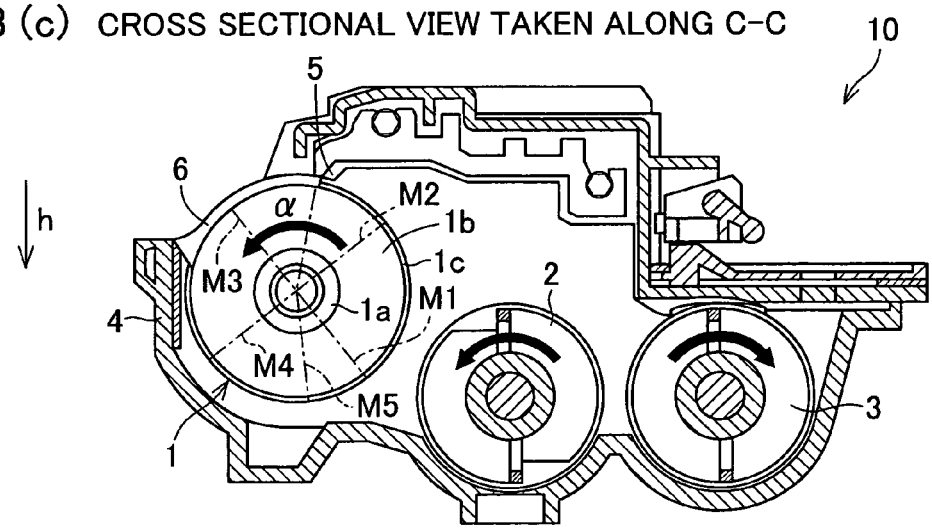

DEVELOPING DEVICE AND IMAGE FORMING APPARATUS PROVIDED WITH SAME

This Nonprovisional application claims priority under 35 U.S.C. § 119(a) on Patent Application No. 2004/302214 filed in Japan on Oct. 15, 2004, the entire contents of which are hereby incorporated by reference.

FIELD OF THE INVENTION

The present invention relates to a developing device which uses a two-component developer, and an image forming apparatus provided with the developing device.

BACKGROUND OF THE INVENTION

Conventionally, an electronic photographic image forming apparatus (printing device) such as a copying device, printer, fax machine or the like, is provided with a photosensitive drum, charging device, exposing device, developing device, transfer device, fixing device, and the like.

In such an image forming apparatus, an electrostatic latent image is formed on a photosensitive surface (electrostatic latent image surface) of the photosensitive drum by electrifying the photosensitive surface by the charging device and then exposing the photosensitive surface to light by the exposing device. Then the thus formed electrostatic latent image is developed with toner (developer) by the developing device, thereby to form a toner image (visible image). The toner image is then transferred onto a sheet (recording medium; a printing medium such as plain paper, OHP sheet, or the like) by the transfer device. After that, the toner image is fixed on the sheet by the fixing device.

Moreover, in general, the developing device provided to the image forming apparatus is provided with a developing roller and a toner tank for storing the toner therein. Rotation of the developing roller delivers the toner on the surface of the photosensitive drum sequentially (continuously).

In delivering the toner onto the surface of the photosensitive drum by the rotation of the developing roller as described above, in a downstream of a nip portion between the developing roller and the photosensitive drum, the toner is sometimes scattered from a gap portion between the developer tank and the developing roller. The toner thus scattered would be possibly attracted to the photosensitive drum and cause quality deterioration of the image to be transferred onto the sheet. The scattering of toner is especially easy to occur on such locations that correspond to ends of the developing roller with respect to a direction of a rotation axis thereof.

Therefore, for example, as illustrated in FIG. 4, a conventional developing device is provided with seals 103 respectively in gap portions between ends of the developing roller 101 with respect to the direction of the rotation axis thereof, and a developer tank 102. The seals 103 are provided in a downstream of a nip portion between the developing roller 101 and the photosensitive drum, and made, for example, of urethane sheet (elastic film) or the like. This arrangement aims to prevent the toner from scattering.

Moreover, for example, Japanese Unexamined Patent Application Publication, Tokukaihei, No. 4-248579 (published on Sep. 4, 1992) discloses an art in which 3Bg>G2>Bg for use of a two-component developer which is prepared by mixing toner and carrier together, where G2 is abase gap between a magnet roll (developing roller) and a developer tank, the base gap being located at an introducing section for introducing the developer into the developer tank, and Bg is a blade gap between the magnet roll and a doctor blade. This art reduces the toner scattering.

However, in the arrangement in which the seals are provided, the seal member is so provided that the seals slide on the developing roller. Therefore, it is inevitable that the seals are deteriorated over age, thereby losing their effect of preventing the toner scattering. Moreover, if the seal member comes off or is bent away, the toner scattering cannot be prevented sufficiently.

Further, if the seals are provided only for the ends of the developing roller with respect to the rotation axis thereof, a direction of air flow between the ends which conventionally causes the toner scattering is merely changed inwardly (i.e., inwardly with respect to the direction of the rotation axis) where the seals are provided. In some cases, such an arrangement is not sufficient to prevent the toner scattering.

Moreover, the art of Japanese Unexamined Patent Application Publication, Tokukaihei, No. 4-248579 is relatively effective to reduce the toner scattering when process speed is slow. But, when the process speed is fast, this art cannot prevent the toner scattering.

This is because the rotation of the developing roller causes swirling of the air in the whole region between the magnetic roller and the developer tank at the introducing section for the developer tank, and the swirling air cannot escape out of the developer tank thereby increasing an internal pressure of the developer tank, and causing a flow of air emitting from an opening in a downstream of the rotation of the developing roller. Furthermore, the narrow base gap G2 between the magnetic roller and the developer tank also increases a flow rate in a region around the narrow base gap. This causes synergic effect with the above phenomenon. The synergic effect causes the toner scattering when the process speed is fast. Therefore, in the art of Japanese Unexamined Patent Application Publication, Tokukaihei, No. 4-248579, a faster speed (process speed) causes a greater internal pressure in the developer tank, thereby making it easy for the toner scattering to occur.

SUMMARY OF THE INVENTION

The present invention was made in view of the aforementioned conventional problems. An object of the present invention is to provide a developing device for use in a two-component developer, in which toner scattering can be appropriately prevented, and an image forming apparatus provided with the same developing device.

In order to attain the object, a developing device according to the present invention includes: a developer tank for containing a two-component developer; and a toner supporting member, positioned so that part thereof is exposed through an opening of the developer tank, for carrying the two-component developer from the developer tank to the part that is exposed through the opening, the developing device developing an electrostatic latent image with the two-component developer thus carried to the part that is exposed through the opening, and the electrostatic latent image being formed on a latent image bearing member of an image forming apparatus, wherein: end gaps are small enough not to allow the two-component developer to flow out from the developer tank through either of end portions (edge portions) of the toner supporting member, and are narrower than a center gap, where the end gaps are smallest gaps between the end portions of the toner supporting member and the developer tank in a downstream of a nip portion between the toner supporting member and the latent image bearing member in a transportation direction of the two-component developer, the end gaps being in a direction perpendicular to the transportation direction, and the center gap is a smallest gap between the developer tank and a center portion of the toner supporting member, the center portion being a portion sandwiched between the end portions.

With this arrangement, in which the end gaps are narrow, it is possible to utilize the toner itself to prevent the developer from scattering out of the developer tank through either of the end gaps. At the end portions of the toner supporting member, there is instability in the amount of the developer carried on the end portions of the toner supporting member and in the amount of the electrification of the developer. Because of such a problem, the scattering of the developer is easy to occur in the end portions of the toner supporting member. The above arrangement, in which the gaps at the end portions are narrow, however, prevents the scattering of the developer in the end portions of the toner supporting member by preventing an air flow at the end portion by utilizing the developer itself to seal the gap.

Furthermore, the center gap is wider than the end gaps in the above arrangement. This attains lower resistance for the flow at the center portion. As a result, the internal pressure, emitting air, or the flow rate of the toner can be kept low in the center portion. Therefore, this arrangement is effective to prevent the scattering of the developer, even for a case where process speed is fast.

An image forming apparatus according to the present invention is provided with the developing device. Therefore, the scatting of the developer is appropriately prevented in the image forming apparatus for use of the two-component developer.

For a fuller understanding of the nature and advantages of the invention, reference should be made to the ensuing detailed description taken in conjunction with the accompanying drawings.

BRIEF DESCRIPTION OF THE DRAWINGS

FIG. 3(*a*) is a cross-sectional view taken along A-A in the developing device in FIG. 1. FIG. 3(*b*) is a cross-sectional view taken along B-B in the developing device in FIG. 1. FIG. 3(*c*) is a cross-sectional view taken along C-C in the developing device in FIG. 1.

DESCRIPTION OF THE EMBODIMENTS

One embodiment of the present invention is described below referring to drawings.

Figure 2:
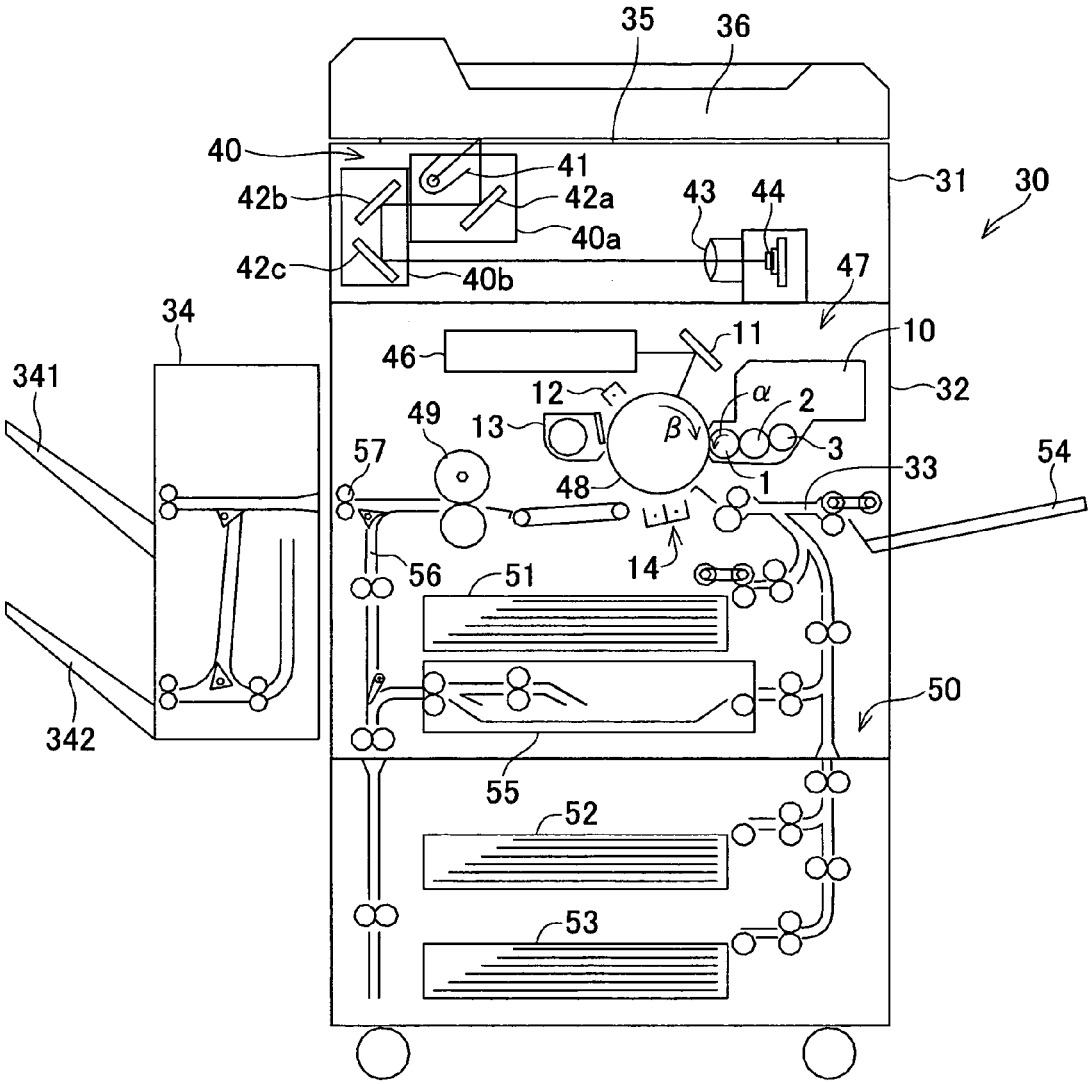
FIG. 2 is a cross-sectional view schematically illustrating an arrangement of an image forming apparatus provided with the developing device according to one embodiment of the present invention.
Figure 4:
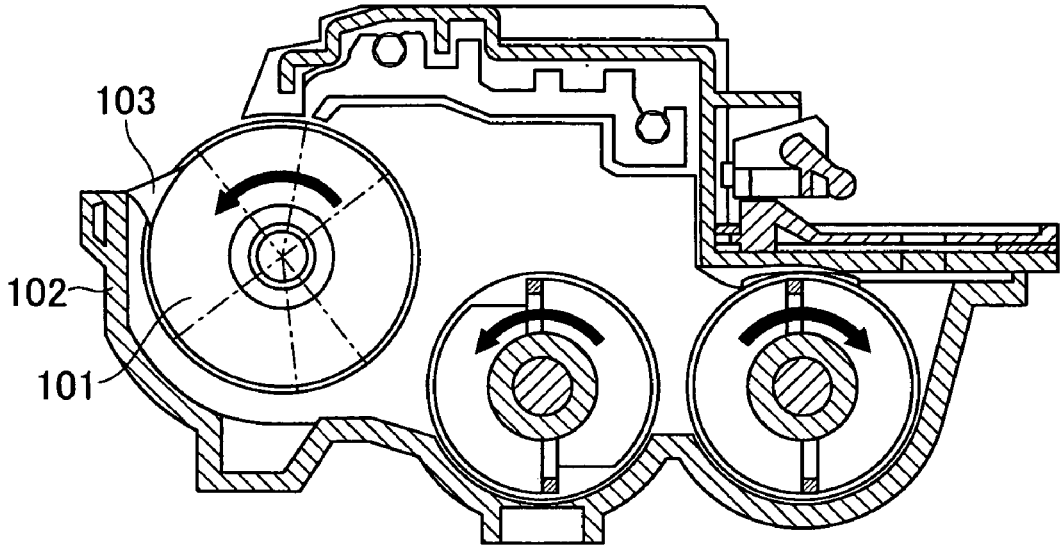
FIG. 4 is a cross-sectional view illustrating an example of arrangement of a conventional developing device.

As illustrated in FIG. 2, a developing device 10 according to the present embodiment is provided to a copying machine (image forming apparatus) 30. The copying machine 30 functions as a copying machine, printer, and faxing machine, and is provided with a scanner section 31 and a laser printer section (laser recording section) 32. Moreover, the copying machine 30 has a process speed (transport speed for sheet (recording material, recording medium)) of 100 mm/sec or higher, which enables the copying machine 30 to perform high-speed image formation.

The scanner section 31 includes a document platform 35, an RADF (Recirculating Automatic Document Feeder) 36, and a scanner unit 40. The document platform 35 is made of transparent glass. The RADF 36 is for automatically supplying a document(s) onto the document platform 35. The scanner unit 40 is a document image reading unit for scanning an image (document image) of the document placed on the document platform 35, thereby to read the image. Image data of the document image thus read by the scanner, section 31 is sent to an image data input section later described, and then subjected to a predetermined image process.

The RADF 36 is a device for automatically delivering documents onto the document platform 35 one by one from a given document tray (not illustrated) in which the documents have been set. Then, after the reading of the document image by the scanner unit 40, the RADF 36 transports the document to a given deliver-out position.

The RADF 36 also functions as a duplex auto document feeder. That is, the RADF 36 has not only a route for one-side printing, but also a route for both-side printing, a guide for switching the routes, sensors for detecting (confirming) and controlling states of the documents, a control section, and the like (all not illustrated), which are used for both-side printing. With this arrangement, the document can be turned up-side-down and transferred back to the document platform 35 after the reading of the document image by the scanner unit 40.

The RADF 36 is so designed that the RADF 36 reads one side or both sides of the document according to selection instruction inputted by a user (operator).

The scanner unit 40 is a document image reading unit for reading, line by line, the image of the document delivered onto the document platform 35. Then, as illustrated in FIG. 2, the scanner unit 40 includes a first scanning unit 40*a*, a second scanning unit 40*b*, an optical lens 43, and a CCD 44.

The first scanning unit 40*a* moves from left to right along the document platform 35 at a constant speed V, so as to cause the document to be exposed to light. As illustrated in FIG. 2, the first scanning unit 40*a* includes a lamp reflector assembly 41 for irradiating the light, and a first reflection mirror 42*a* for guiding reflection light from the document to the second scanning unit 40*b*.

The second scanning unit 40*b* moves at a speed V/2, following the first scanning unit 40*a*. The second scanning unit 40*b* includes a second reflection mirror 42*b* and a third reflection mirror 42*c*. The light reflected by the first reflection mirror 42*a* is guided toward the optical lens 43 and the CCD 44 by the second reflection mirror 42*b* and third reflection mirror 42*c*.

An optical lens 43 focuses, on the CCD 44, the light reflected from the third reflection mirror 42*c*.

The CCD (Charge Coupled Device; photoelectric transfer element) 44 converts, into electric signals (electric image signals), the light thus focused thereon by the optical lens 43. The electric signals (which are analog) obtained by the CCD 44 are converted into image data (which is digital) by the CCD board (not illustrated) to which the CCD 44 is provided. Then, the image data is subjected to various image processes by an image processing section and stored in a memory (not illustrated). Then, the image data is transmitted to a laser printer section 32 according to an output instruction from a main CPU (not illustrated) of the copying machine 30.

As illustrated above, the scanner section 31 is arranged such that, by using the scanner unit 40 moved along a lower surface of the document platform 35, the document images are read from the documents to be read, which are sequentially delivered on the document platform 35 by the cooperation of the RADF 36 and the scanner unit 40.

The laser printer section 32 is for forming an image on the sheet (recording material, recording medium) according to the image data. The laser printer section 32 is, as illustrated in FIG. 2, provided with a laser writing unit 46, an electronic photographic process section 47, and a sheet transporting system 50.

The laser writing unit 46 is for forming the electrostatic latent image according to the image data thus read by the scanner section 31 (scanner unit 40), or image data externally supplied thereto. For forming the electrostatic latent image, the laser writing unit 46 irradiates a laser beam onto a photosensitive drum (latent image bearing member) provided in the electronic photographic process section 47. The laser writing unit 46 includes a semiconductor laser beam source, a polygon mirror, and f-θ lens (all not illustrated). The polygon mirror, rotated at a constant speed, deflects the laser beam. Here, the laser beam thus deflected by the polygon mirror is corrected by the f-θ lens, so that the laser beam is deflected on the surface of the photosensitive drum 48 at a constant speed.

The electronic photographic process section 47 is provided with the photosensitive drum 48, an electric charger 12, an exposure mirror 11, a developing device (developing apparatus) 10, a transfer device 14, a peeler (not illustrated), a cleaner 13, and a electric discharger (not illustrated). The electric charger 12, the exposure mirror 11, the developing device (developing apparatus) 10, the transfer device 14, the peeler (not illustrated), the cleaner 13, and the electric discharger (not illustrated) are provided around the photosensitive drum 48.

The electric charger 12 electrifies the surface of the photosensitive drum 48 for the formation of the electrostatic latent image performed by the laser writing unit 46.

The developing device 10 forms a toner image by developing the electrostatic latent image formed on the photosensitive drum 48 by the laser writing unit 46. The developing device 10 uses a two-component developer containing toner and carrier. In the following, the two-component developer is just referred to as "toner" for the sake of easy explanation. An arrangement of the developing device 10 is described later.

The transfer device 14 performs electrostatic transfer of the toner image onto the sheet (recording material, recording medium), the toner image thus created by the developing device 10.

The sheet transport system 50 delivers the sheet to the electronic photographic process section 47. Further, the sheet transport system 50 fixes the image thus transferred on the sheet and then delivers out the sheet to outside. Then, as illustrated in FIG. 2, the sheet transport system 50 is provided with a transporting section 33, cassette sheet feeders 51 to 53, a manual sheet feeder 54, a fixing device 49, re-supplying routes 55 and 56, a sheet delivering-out roller 57, and a post-process device 34.

The transporting section 33 is for transporting the sheet to a predetermined transfer position (where the transfer device 14 is positioned) in the electronic photographic process section 47.

The cassette sheet feeders 51 to 53 store therein the sheet to which the image is to be transferred, and are for sending the sheet to the transporting section 33 for the transfer process. Moreover, the manual sheet feeder 54 is a device for supplying a sheet to the transporting section 33 manually. For supplying, to the transporting section 33, a sheet of a type or size different from those stored in the cassette sheet feeders 51 to 53, the manual sheet feeder 54 is used. By the electronic photographic process section 47, the toner image visualized with the toner is transferred, by the electrostatic transfer, onto a surface of the sheet transported from one of the sheet feeding section of multi-staged sheet feeding unit (cassette sheet feeders 51 to 53 and the manual sheet feeder 54) and then fixed thereon.

The fixing device 49 is for fixing the transferred toner image on the sheet.

The re-supplying routes 55 and 56 are routes for re-supplying the sheet to the transporting section 33 in order to form an image on a reverse surface of the sheet after fixing of the toner image. Moreover, the post-process device 34 is provided at an exit of the sheet delivering-out roller 57 in a downstream of the fixing device 49. The post-process device 34 is for performing post process (such as stapling and/or the like) for the delivered-out sheet. The post-process device 34 is provided with deliver-out sheet trays 341 and 342 for storing the sheet transported (delivered out) thereto after the post process (such as stapling and/or the like).

Next, the arrangement of the developing device 10 is described below. As illustrated in FIG. 2, the developing device 10 is provided with a developing roller (toner supporting member) 1, stirring rollers 2 and 3, a developer tank 4, and a doctor blade 5.

The developer tank 4 is a container (toner tank) for storing the toner therein. The developer device 10 is so arranged as to use the two component developer including minute-diameter toner (toner) having an average particle diameter of approximately 7.6 μm, and minute-diameter carrier (carrier) having an average particle diameter of approximately 90 μm. The two component developer has a toner concentration of 4%. The present invention is not limited to such two component developer. However, it is preferable to use two component developer including minute-diameter toner (toner) having an average particle diameter of not less than 6 μm but not more than 10 μm, and minute-diameter carrier (carrier) having an average particle diameter of not less than 60 μm but not more than 120 μm, and having a toner concentration of not less than 2% but not more than 5%.

The stirring rollers 2 and 3 are provided in the developer tank 4, and stir the toner thereby to electrify the toner slightly.

The doctor blade (upstream gap regulating means) 5 is positioned in the upstream of a nip portion between the developing roller 1 and the photosensitive drum 48 in the developer tank 4. The doctor blade 5 regulates a doctor gap (upstream gap) Dg, which is a gap between the developing roller 1 and a tip of the doctor blade 5 (developer tank 4). The doctor blade 5 scratches off part of the toner attracted on the developing roller 1. The developing device 10 is so arranged that the doctor gap Dg is approximately 0.5 mm. The present invention is not limited to the doctor gap Dg of this value, however. It is preferable that 0.2 mm<Dg<1.5 mm. With a too small doctor gap Dg, the toner attracted (carried) on the developing roller 1 cannot pass through the gap portion, so that sufficient supply of toner to the photosensitive drum 48 cannot be done. Moreover, a too large doctor gap Dg is not preferable, too, because an excessively large amount of toner would be supplied to the photosensitive drum 48 thereby deteriorating the quality of the image, the carrier would fall off at a developing nip portion, and/or other problem would occur.

The developing roller (carrying section) 1 is a roller having a cylinder-like shape, and is partially exposed from an opening of the developer tank 4. The exposed part of the developing roller 1 faces to the photosensitive drum 48. The developing roller 1 carries the toner from the developer tank 4 to the position where the exposed part faces to the photosensitive drum 48. With this, the toner can be attracted to the electrostatic latent image formed on the photosensitive drum 48, thereby making it possible to develop the electrostatic latent image so as to form the toner image.

The developing roller 1 rotates in a direction (indicated by the arrow a in FIG. 2) opposite to a rotation direction (indicated by the arrow β in FIG. 2) of the photosensitive drum 48. That is, at the nip portion (development nip portion, adjacency portion) between the developing roller 1 and the photosensitive drum 48, the developing roller 1 and the surface of the photosensitive drum 48 at the nip portion move in the same direction. In other words, the developing roller 1 performs same-direction rotation ("with" rotation). The developing roller 1, with the toner on its surface, is rotated in touch with the photosensitive drum 48.

The developing roller 1 rotates at such a speed that its surface at the nip portion moves at the same speed as the surface of the photosensitive drum 48 at the nip portion. The surface of the photosensitive drum 48 moves at the same speed as the sheet (recoding material, recording medium), that is, as the process speed of the copying machine 30. Therefore, the present embodiment is arranged such that, in order to attain a printing speed of 45 sheets per min, the surface of the developing roller 1 at 225 mm/sec, which is higher than 100 mm/sec.

Figure 1:
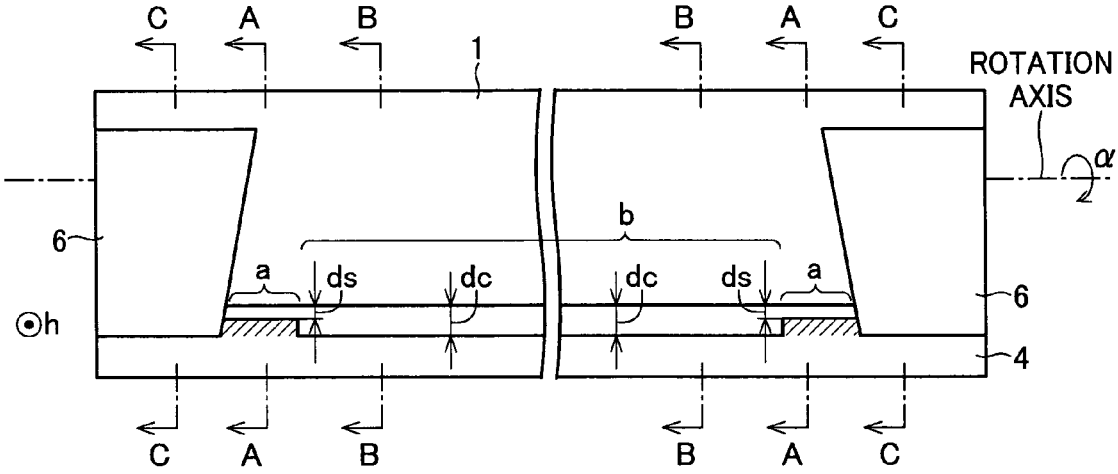
FIG. 1 is a plane view illustrating part of a developing device according to one embodiment of the present invention.

FIG. 1 is a plane view illustrating the developing roller 1 and the developer tank 4 partially. FIG. 3(*a*) is a cross-sectional view taken along A-A in the developing device in FIG. 1. FIG. 3(*b*) is a cross-sectional view taken along B-B in the developing device in FIG. 1. FIG. 3(*c*) is a cross-sectional view taken along C-C in the developing device in FIG. 1.

As illustrated in FIGS. 3(*a*) to 3(*c*), the developing roller 1 is provided with a sleeve 1*c*, a core 1*a*, and a multipolar magnet 1*b*. The sleeve 1*c* is made of a non-magnetic material and has a cylinder-like shape. The core 1*a* is provided in the sleeve 1*c*. The multipolar magnet 1*b* is firmly held by the core 1*a*. The core 1*a* is fixedly attracted to the copying machine 30. The developing roller 1 is so arranged that the sleeve 1*c* rotates along a periphery of the multipolar magnet 1*b*.

Moreover, the multipolar magnet 1*b* has five types of magnetic domains (magnet poles; first magnetic pole M1 to fifth magnetic pole M5). The five magnetic domains are segmented with lines, radically extended from a center of the multipolar magnet 1*b*.

The first magnetic pole M1 is for attracting the toner to the sleeve 1*c*. The second magnetic pole M2 is next to the first magnetic pole M1 in its downstream (in the α direction), and is for transferring the toner attracted on the sleeve 1*c*.

The third magnetic pole (main magnetic pole) M3 is next to the second magnetic pole in the downstream and is in a development position which faces the surface of the photosensitive drum 48. The third magnetic pole M3 transfers, to an area where the doctor blade 5 is position, the developer attracted to the sleeve 1*c*. The doctor blade 5 regulates a developer layer in thickness. Then, the toner is attracted to the surface of the photosensitive drum 48 by rubbing (treating) the surface of the photosensitive drum 48 with a magnetic bush, thereby to develop (visualize) the electrostatic latent image.

The fourth magnetic pole M4 is provided in the downstream of the third magnetic pole M3, and is for transporting, into the developer tank, the developer that has passed the development nip, and for removing the developer from the sleeve 1*c* by an effect of magnetic relationship between the fourth magnetic pole M4 and the fifth magnetic pole M5. The third magnetic pole M3 is provided in that portion of the developing roller 1 which faces the photosensitive drum 48. This portion may not be the nip portion between the photosensitive drum 48 and the developing roller 1 (i.e. the portion of the developing roller 1 which is closest to the photosensitive drum 48), and may be a portion in the vicinity of the nip portion (upstream or downstream of the nip portion in the direction of the transport).

In the present embodiment, the first magnetic pole M1, the third magnetic pole M3, and the fifth magnetic pole M5 are N pole, and the second magnetic pole M2 and the fourth magnetic pole M4 are S pole.

Moreover, as illustrated in FIG. 1, the developing roller 1 has a cylinder-like shape having a substantially constant diameter with respect to the direction of its rotation axis.

Meanwhile, that portion of the developer tank 4 which is in the downstream of the development nip and faces the development roller 1 has such a shape that an end gap ds which is a smallest gap between the developer tank 4 and either end portion a of the developing roller 1 is smaller than a center gap dc which is a smallest gap between a center portion b (which is between the end portions a) and the developer tank 4 (the end portion of the developing roller 1 is an end portion thereof with respect to a rotation direction of the developing roller 1).

If the end gap ds is too narrow, the toner attracted onto the developing roller 1 could not pass through an end gap portion (gap) having the too narrow end gap ds, so that the toner would fall off from the developer tank 4. Therefore, the end gap ds is preferable larger than the gap (doctor gap) Dg between the tip of the doctor blade 5 and the developing roller 1.

Moreover, if the end gap ds is too wide, it becomes impossible to prevent the scattering of the toner from the developer tank 4 appropriately. That is, the developing device 10 is so arranged that, in the gap portion between either end portion a of the developing roller 1 and the developer tank 4, the sealing is done with the developer itself (i.e., the developer itself is utilized to protect the developer from scattering). In such a developing device 10, the sealing becomes less effective and the toner scattering cannot be prevented appropriately if the end gaps ds are too wide. To attain appropriate prevention of the toner scattering, it is preferable that the eng gaps ds are less than triple of the doctor gap Dg, and more preferable that the eng gaps ds are equal to or less than double of the doctor gap Dg.

Therefore, it is preferable that $Dg<ds<3Dg$, and is more preferable that $Dg<ds\leqq 2Dg$.

On the other hand, the center gap dc is preferably larger than the end gaps ds, in order to prevent an internal pressure in the developer tank 4 and a flow rate of the air from being increased in the gap portion between the developer tank 4 and the center portion b of the developing roller 1. The increase of the internal pressure in the developer tank 4 and the increase of the flow rate of the air from the gap portion between the developer tank 4 and the center portion b of the developing roller 1 would cause toner scattering. That is, the center gap ds larger than the end gaps ds prevents the air from swirling at the center portion and escapes, from the center gap, the air that is swirling at the end portions a. This prevents the increases of the internal pressure in the developer tank 4 and the flow rate of the air, thereby to prevent the toner scattering.

Moreover, the gap portion between the developer tank 4 and the center portion b of the developing roller 1 is preferably arranged such that the toner attracted on the developing roller 1 in the center portion b does not touch the developer tank 4. Therefore, the center gap dc is preferably larger than the triple of the doctor gap Dg.

Moreover, if the center gap dc is too wide, the gap between the developing roller 1 and the photosensitive drum 48 becomes too large to perform the development appropriately. Moreover, there is a risk that a part of the developer tank 4 interferes the photosensitive drum 48, thereby to prevent smooth rotation of the photosensitive drum 48. Therefore, it is preferable that the center gap dc is smaller than 6 times of the doctor gap Dg.

Therefore, it is preferable that $3Dg<dc<6Dg$.

Moreover, as illustrated in FIG. 1, seals (DV (Developer seal)) 6 are provided on outward sides with respect to the end portions a of the developing roller 1. The seals 6, as illustrated in FIG. 3(*c*), rub that portion of the periphery of the developing roller 1 which are from the immediate downstream of the doctor blade 5 to the end of the opening of the developer tank 4 in the downstream of the development nip portion. With this arrangement, it becomes possible to appropriately prevent the toner scattering from that portion of the periphery of the developing roller 1 which are from the immediate downstream of the doctor blade 5 to the end of the opening of the developer tank 4 in the downstream of the development nip portion.

Moreover, the seal 6 is, as illustrated in FIG. 3(*a*), wider in the upstream than in the downstream in the rotation direction of the developing roller 1. That is, an area in which the developing roller 1 does not touch with the seal 6 becomes gradually larger along the rotation direction of the development roller 1 from the upstream thereof to the downstream thereof. This arrangement surely prevents accumulation of the toner on an interface between the developing roller 1 and the seal 6, which accumulation of the toner results in attachment of the toner on the photosensitive drum 48.

Moreover, as illustrated in FIGS. 3(*a*) to 3(*c*), the developing device 10 is so arranged that the end gaps ds and the center gap dc are positioned between the main magnetic pole (the third magnetic pole M3) of the developing roller 1 and a sub magnetic pole (the fourth magnetic pole M4) located next to the main magnetic pole in the downstream thereof.

Therefore, the magnetic field in a normal direction of the surface of the developing roller 1 between the main and sub magnetic poles is substantially zero, and a direction of the magnetic field is substantially along a tangent direction (substantially in a direction perpendicular to the normal direction). Therefore, the developer is attracted in the tangent direction, so that the developer attracted in the developing roller 1 can smoothly pass through the narrow gap portions (the portions of the end gaps ds and the center gap dc), thereby to make it possible to prevent fall-off and buildup of the developer.

As described above, the developing device 10 according to the present embodiment is arranged such that the gaps ds between the developer tank 4 and the end portions a of the developing roller 1 in the direction of its rotation axis are narrow. With this arrangement, it is possible to utilize the developer itself to prevent the toner from scattering out of the developer tank 4. At the end portions of the developing roller 1, the magnetic field of the developing roller 1 (the fourth magnetic pole M4) for magnetically attracting the toner is weak. The weak magnetic field for examples results in instability in the amount of the toner carried in the end portions of the developing roller 1 and in the amount of the electrification of the toner. Because of such a problem, the toner scattering is easy to occur in the end portions of the developing roller 1. The above arrangement, in which the gaps at the end portions are narrow, prevents the toner scattering in the end portions of the developing roller 1 by utilizing the developer itself to seal the gap.

For the end gaps ds, which are gaps between the developer tank 4 and either end portion a of the developing roller 1 in the rotation direction, it is preferable that $Dg<ds<Dg$, and more preferable that $Dg<ds\leqq 2Dg$, where Dg is a gap (doctor gap) between the developing roller 1 and the doctor blade 5.

This arrangement can appropriately prevent the toner from scattering from the developer tank 4, and can prevent the toner from falling out of the toner tank 4 because the toner attached on the developing roller 1 cannot pass through the gap portion (gap) between the developing roller 1 and the developer tank 4.

Moreover, the developing section 10 is arranged such that the center gap dc is wider than the end gaps ds.

This arrangement ensures a predetermined gap amount in the region (center portion b) except the end portions a, thereby to provide a lower resistance for the flow. As a result, the internal pressure, emitting air, or the flow rate of the toner can be kept low in the region (center portion b) except the end portions a. Therefore, for example, even if the process speed is a high speed such as 100 mm/s or higher, that is, if the surface of the developing roller 1 moves at 100 mm/s or higher, this arrangement is effective to prevent the toner scattering.

Moreover, for the center gap dc, which is the narrowest gap between the developer tank 4 and the center portion b of the developing roller 1, it is preferable that $3Dg<dc<6Dg$.

With this arrangement, it is possible to prevent the increases of the internal pressure of the developer tank 4 and the flow rate of the air or the toner in the gap portion between the developer tank 4 and the center portion b of the developing roller 1, thereby appropriately preventing the toner scattering. Moreover, it is possible to allow the developing roller 1 and the photosensitive drum 48 to have such a gap therebetween that allows them to perform the development appropriately. Moreover, this arrangement allows smooth rotation of the photosensitive drum 48 because the photosensitive drum 48 is not interfered with the part of the developer tank 4.

Moreover, the developing device 10 is provided with seals for rubbing the periphery surfaces (developer carrying surface) of the developing roller 1 on outward sides of the end portions a. With this arrangement, it is possible to surely prevent the toner scattering.

Moreover, the developing device 10 is arranged such that the end gaps ds and the center gap dc are positioned between the main magnetic pole (the third magnetic pole M3) and the sub magnetic pole (the fourth magnetic pole M4) located next to the main magnetic pole in the downstream thereof. Therefore, the magnetic field in the normal direction of the surface of the developing drum 1 in the region between the main and sub magnetic poles is substantially zero, the direction of the magnetic field is substantially in the tangent direction. Therefore, the developer is attached in orientation according to the tangent direction. Because of this, the developer attracted on the developing roller 1 can smoothly pass through the narrow gap portion (the end gaps ds and the center gap dc), thereby preventing the fall-off and buildup of the developer.

Moreover, generally-used conventional seals provided on both sides and made of an elastic film merely deter the outward flow of the air or the toner slightly inwardly and are not so effective to prevent the toner scattering. On the other hand, in the developing device 10, it is possible to appropriately prevent the outward flow of the air or the toner, and thus the toner scattering can be appropriately prevented. Furthermore, the generally-used conventional seals provided on both sides and made of an elastic film has a problem in that the seals may be bended and may be deteriorated over age. The developing device 10 is free from such bending or deterioration over age. Therefore, in the developing device 10, high sealing is reliable over long time. Moreover, in the developing device 10, it is unnecessary to adhere the seals in the manufacturing process. Therefore, assembling workability is higher in the developing device 10. Moreover, maintenance for replacing/exchanging the seals due to the bending or the deterioration over age is unnecessary in the developing device 10. Therefore, the developing device 10 has a lower running cost.

Moreover, the present invention is not limited to the arrangement of the developing device 10 in which the photosensitive drum 48 and the developing roller 1 are rotated in the same direction ("with" direction). The rotation direction of the photosensitive drum 48 and that of the developing roller 1 may be the same, that is, they performs counter rotation ("against" rotation) by which they moves in opposite directions at the nip portion.

In the case of the counter rotation, the toner is scattered from the upstream of the nip portion in the rotation direction of the photosensitive drum 48. On the other hand, in the case of the "with" rotation, the toner is scattered from the downstream of the nip portion in the rotation direction of the photosensitive drum 48. Here, in the case where the toner is scattered from the upstream of the nip portion in the rotation direction of the photosensitive drum 48, the toner scattered onto the photosensitive drum 48 can be collected by using the developing roller 1. This can prevent deterioration of the quality of the image to some extent.

On the other hand, in the case where the toner is scattered from the downstream of the nip portion in the rotation direction of the photosensitive drum 48, the toner scattered on the photosensitive drum 48 is transported to the region where the photosensitive drum 48 faces the transferring device 14. This deteriorates the quality of the image more significantly. In the developing device 10 according to the present embodiment, however, it is possible to prevent the toner scattering appropriately. Therefore, it is possible to prevent the deterioration of the quality of image even in the image forming apparatus having the "with" rotation.

The present invention is not limited to the arrangement of the developing device 10 in which the two stirring rollers are provided. The developing device according to the present invention may be provided with only a single stirring roller, or three or more stirring rollers.

The present invention is not limited to the arrangement of the present embodiment in which the toner supporting member and the latent image bearing member are the developing roller 1 and the photosensitive drum 48 which have cylinder-like shapes. The toner supporting member and the latent image bearing member may have a shape(s) other than the cylinder-like shapes.

Moreover, even though the present embodiment discusses the case where the developing device 10 is applied in the copying machine 30 having the functions of the copying machine, printer, and the faxing machine, the present invention is not limited to this. The developing device 10 is applicable to any image forming apparatus which perform image formation by transfer of a toner image.

A developing device according to the present invention includes: a developer tank for containing a two-component developer; and a toner supporting member, positioned so that part thereof is exposed through an opening of the developer tank, for carrying the two-component developer from the developer tank to the part that is exposed through the opening, the developing device developing an electrostatic latent image with the two-component developer thus carried to the part that is exposed through the opening, and the electrostatic latent image being formed on a latent image bearing member of an image forming apparatus, wherein: end gaps are small enough not to allow the two-component developer to flow out from the developer tank through either of end portions of the toner supporting member, and are narrower than a center gap, where the end gaps are smallest gaps between the end portions of the toner supporting member and the developer tank in a downstream of a nip portion between the toner supporting member and the latent image bearing. member in a transportation direction of the two-component developer, the end gaps being in a direction perpendicular to the transportation direction, and the center gap is a smallest gap between the developer tank and a center portion of the toner supporting member, the center portion being a portion sandwiched between the end portions.

With this arrangement, in which the end gaps are narrow, it is possible to utilize the two-component developer itself to prevent the two-component developer from scattering out of the developer tank through either of the end gaps. At the end portions of the toner supporting member, there is instability in the amount of the developer carried on the end portions of the toner supporting member and in the amount of the electrification of the developer. Because of such a problem, the scattering of the developer is easy to occur in the end portions of the toner supporting member. The above arrangement, in which the gaps at the end portions are narrow, however, prevents the scattering of the developer in the end portions of the toner supporting member by preventing an air flow at the end portion by utilizing the developer itself to seal the gap.

Furthermore, the center gap is wider than the end gaps in the above arrangement. This attains lower resistance for the flow at the center portion. As a result, the internal pressure in the developer tank, and the flow rate of the emitting air can be kept low in the center portion. Therefore, this arrangement is effective to prevent the scattering of the developer even for a case where process speed is fast.

Moreover, the developing device may include: upstream gap regulating means for regulating an upstream gap, which is a smallest gap between the developer tank and the toner supporting member in an upstream of the nip portion of the toner supporting member and the latent image bearing member in the transportation direction of the two-component developer, the end gaps and the upstream gap being such that $Dg<ds<3Dg$, where ds is the end gap and Dg is the upstream gap.

This arrangement prevents a problem in that the two-component developer attracted on the toner supporting member cannot pass through the gap portion between the developer tank and the toner supporting member, and falls off outside, and the problem of the scattering of the two-component developer from the developer tank.

The developing device may be arranged such that 3Dg<dc<6Dg, where dc is the center gap.

With this arrangement, it is possible to prevent the increases of the internal pressure of the developer tank and the flow rate of the air in the gap portion between the developer tank and the center portion of the toner supporting member, thereby appropriately preventing the scattering of the two-component developer. Moreover, it is possible to allow the toner supporting member and the latent image bearing member to have such a gap therebetween that allows them to perform the development appropriately. Moreover, this arrangement allows smooth rotation of the latent image bearing member because the latent image bearing member is not interfered with the part of the developer tank.

The developing device may be arranged such that a surface of the toner supporting member moves at a speed of 100 mm/sec or higher, the surface being for carrying the two-component developer thereon.

With this arrangement, even if the surface of the toner supporting member, on which the developer is carried is moved at a high speed of 100 mm/sec or more, it is possible to prevent the increases of the internal pressure of the developer tank and the flow rate of the air. This appropriately prevents the scattering of the toner.

Moreover, a developing device may include: seals, respectively being positioned on outward sides of the end portions (outward sides of the end portions with respect to the direction perpendicular to the transport direction) of the toner supporting member and being in touch with a surface of the toner supporting member, the surface being for carrying the two-component developer thereon. This arrangement prevents the scattering of the two-component developer more surely.

Furthermore, a developing device may be arranged such that the toner supporting member includes: a main magnetic pole, positioned in a region where the latent image bearing member and the toner supporting member face each other, for causing the two-component developer to be attached on the latent image bearing member; and a sub magnetic pole, positioned next to the main magnetic pole in the downstream of the transportation direction, for removing, from the toner supporting member, the two-component developer that is not attached to the latent image bearing member, the main magnetic pole and the sub magnetic pole sandwiching the end gaps and the center gap therebetween.

With this arrangement, the magnetic field along the normal direction of the surface of the toner supporting member in the region between the main and sub magnetic poles is substantially zero, and the magnetic field direction is substantially perpendicular to the normal direction. Therefore, the two-component developer is attracted in orientation according to the direction perpendicular to the normal direction. Because of this, the two-component developer attracted on the toner supporting member can smoothly pass through the end gap portions and the center gap portion, thereby avoiding fall-off and buildup of the two-component developer.

The developing device may be arranged such that the latent image bearing member and the toner supporting member move in the same direction at the nip portion between the latent image bearing member and the toner supporting member.

In the case where the latent image bearing member and the toner supporting member move in the same direction at the nip portion, there is a risk that the latent image holder is attached with the scattered developer after the development, if the developer scatters in the downstream of the nip in the moving direction of the latent image bearing member, that is, the transportation direction of the developer. The developer attached to the latent image bearing member cannot be collected, thereby causing deterioration of the quality of the image.

In the developing device according to the present invention, however, the scattering of the developer is appropriately prevented. Therefore, even in the case where the latent image bearing member and the toner supporting member move in the same direction at the nip portion, the deterioration of the quality of the image is appropriately prevented in the developing device according to the present invention.

An image forming apparatus according to the present invention is provided with any of the developing devices. Because of this, the scattering of the developer is appropriately prevented in the image forming apparatus for use of the two-component developer.

The present invention is applicable to a developing device for use of a two-component developer. The present invention can appropriately prevent the toner scattering even in a developing device having a high process speed. Therefore, the present invention is especially suitable for a developing device provided in an image forming apparatus for high image forming speed.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A developing device comprising: a developer tank for containing a two-component developer; and a toner supporting member, positioned so that part thereof is exposed through an opening of the developer tank, for carrying the two-component developer from the developer tank to the part that is exposed through the opening, the developing device developing an electrostatic latent image with the two-component developer thus carried to the part that is exposed through the opening, and the electrostatic latent image being formed on a latent image bearing member of an image forming apparatus, wherein:

end gaps are small enough not to allow the two-component developer to flow out from the developer tank through either of end portions of the toner supporting member, and are narrower than a center gap, where the end gaps are smallest gaps between the end portions of the toner supporting member and the developer tank in a downstream of a nip portion between the toner supporting member and the latent image bearing member in a transportation direction of the two-component developer, the end gaps being in a direction perpendicular to the transportation direction, and the center gap is a smallest gap between the developer tank and a center portion of the toner supporting member, the center portion being a portion sandwiched between the end portions.

2. A developing device as set forth in claim 1, comprising:

upstream gap regulating means for regulating an upstream gap, which is a smallest gap between the developer tank and the toner supporting member in an upstream of the nip portion of the toner supporting member and the latent image bearing member in the transportation direction of the two-component developer, the end gaps and the upstream gap being such that Dg<ds<3Dg, where ds is the end gap and Dg is the upstream gap.

3. A developing device as set forth in claim 2, wherein: $3Dg<dc<6Dg$, where dc is the center gap.

4. A developing device as set forth in claim 1, wherein:

a surface of the toner supporting member moves at a speed of 100 mm/sec or higher, the surface being for carrying the two-component developer thereon.

5. A developing device as set forth in claim 1, comprising:

seals, respectively being positioned on outward sides of the end portions of the toner supporting member and being in touch with a surface of the toner supporting member, the surface being for carrying the two-component developer thereon.

6. A developing device as set forth in claim 1, wherein:

the toner supporting member includes:

a main magnetic pole, positioned in a region where the latent image bearing member and the toner supporting member face each other, for causing the two-component developer to be attached on the latent image bearing member; and a sub magnetic pole, positioned next to the main magnetic pole in the downstream of the transportation direction, for removing, from the toner supporting member, the two-component developer that is not attached to the latent image bearing member, the main magnetic pole and the sub magnetic pole sandwiching the end gaps and the center gap therebetween.

7. A developing device as set forth in claim 1, wherein:

the latent image bearing member and the toner supporting member move in the same direction at the nip portion between the latent image bearing member and the toner supporting member.

8. An image forming apparatus, comprising a developing device, wherein:

the developing device comprises: a developer tank for containing a two-component developer; and a toner supporting member, positioned so that part thereof is exposed through an opening of the developer tank, for carrying the two-component developer from the developer tank to the part that is exposed through the opening, the developing device developing an electrostatic latent image with the two-component developer thus carried to the part that is exposed through the opening, and the electrostatic latent image being formed on a latent image bearing member of an image forming apparatus, and end gaps are small enough not to allow the two-component developer to flow out from the developer tank through either of end portions of the toner supporting member, and are narrower than a center gap, where the end gaps are smallest gaps between the end portions of the toner supporting member and the developer tank in a downstream of a nip portion between the toner supporting member and the latent image bearing member in a transportation direction of the two-component developer, the end gaps being in a direction perpendicular to the transportation direction, and the center gap is a smallest gap between the developer tank and a center portion of the toner supporting member, the center portion being a portion sandwiched between the end portions.

* * * * *